US010676241B1

(12) United States Patent
Kaldahl

(10) Patent No.: US 10,676,241 B1
(45) Date of Patent: Jun. 9, 2020

(54) AMMUNITION CONTAINER

(71) Applicant: Jeffrey W. Kaldahl, Denver, CO (US)

(72) Inventor: Jeffrey W. Kaldahl, Denver, CO (US)

(73) Assignee: Jeffrey W. Kaldahl, Denver, CO (US)

( * ) Notice: Subject to any disclaimer, the term of this patent is extended or adjusted under 35 U.S.C. 154(b) by 0 days.

(21) Appl. No.: 15/668,343

(22) Filed: Aug. 3, 2017

(51) Int. Cl.

| | |
|---|---|
| ***F42B 39/24*** | (2006.01) |
| ***B65D 25/04*** | (2006.01) |
| ***B65D 25/28*** | (2006.01) |
| ***B65D 43/16*** | (2006.01) |
| ***B65D 43/22*** | (2006.01) |
| ***B65D 25/24*** | (2006.01) |
| ***F42B 39/26*** | (2006.01) |

(52) U.S. Cl.
CPC ..... *B65D 25/04* (2013.01); *B65D 25/24* (2013.01); *B65D 25/2858* (2013.01); *B65D 43/163* (2013.01); *B65D 43/22* (2013.01); *F42B 39/26* (2013.01)

(58) Field of Classification Search
CPC ..... B65D 25/04; B65D 25/2858; B65D 2525/286; B65D 2571/00512; B65D 1/24; B65D 1/36; B65D 5/48; B65D 7/065; F42B 39/26; A45C 201/267
USPC ..... 220/529, 524, 500, 553, 752, 757, 761, 220/763, 770, 775, 773; 206/508
See application file for complete search history.

(56) References Cited

U.S. PATENT DOCUMENTS

| | | | | | |
|---|---|---|---|---|---|
| 363,664 | A * | 5/1887 | Metzger | B65D 51/28 | 220/521 |
| 423,650 | A * | 3/1890 | Wilkins | B65D 25/04 | 220/524 |
| 2,078,096 | A * | 4/1937 | Parkin | A45D 33/006 | 220/523 |
| 2,826,332 | A * | 3/1958 | Hudson | B65D 25/2823 | 206/164 |
| 4,632,888 | A * | 12/1986 | Kump | H01M 2/1005 | 16/DIG. 15 |
| 4,752,543 | A * | 6/1988 | Anderson | H01M 2/043 | 429/122 |
| 4,976,369 | A * | 12/1990 | Shindo | B65D 25/32 | 220/270 |
| 5,050,760 | A * | 9/1991 | Garcia | B65D 25/32 | 220/751 |
| 5,447,252 | A * | 9/1995 | Ward | B65D 21/064 | 220/756 |
| 2001/0035416 | A1* | 11/2001 | Dodson | A47K 10/421 | 220/524 |
| 2006/0108368 | A1* | 5/2006 | Dube | B25H 3/02 | 220/552 |

(Continued)

*Primary Examiner* — Robert Poon
(74) *Attorney, Agent, or Firm* — Polsinelli PC

(57) ABSTRACT

Disclosed herein are ammunition containers including features that improve storage, transportation, and organization of the ammunition containers. The ammunition containers include multiple container portions separated by a divider, each container portion or subset of container portions having a respective lid that is independently movable of one or more other lids. A handle coupled to the divider is movable into a first position in which the handle is retracted or otherwise disposed such that the handle is flush with or below a top surface of the ammunition container. The handle is further movable into a second position to facilitate handling of the ammunition container.

18 Claims, 8 Drawing Sheets

(56) References Cited

U.S. PATENT DOCUMENTS

| | | | | |
|---|---|---|---|---|
| 2008/0128441 | A1* | 6/2008 | Chen | A45C 13/26<br>220/761 |
| 2015/0021322 | A1* | 1/2015 | Rosenblum | B65D 21/0223<br>220/23.89 |

* cited by examiner

AMMUNITION CONTAINER

TECHNICAL FIELD

Aspects of the present disclosure relate to ammunition containers, and more particularly to a multi-compartment ammunition container.

BACKGROUND

Proper transportation and storage of ammunition is an important component of general firearm safety. For example, improper organization of stored ammunition may contribute to a shooter selecting a round from a container having a different bullet type, caliber, or a higher load than expected, each of which may in turn lead to misfires, damage to the firearm being used, harm to the shooter, and unexpected ballistic behavior. Ammunition containers must also securely store ammunition and allow for easy handling to reduce the likelihood of inadvertent spilling of or access to the ammunition stored within.

It is with these observations in mind, among others, that aspects of the present disclosure were conceived.

SUMMARY

Disclosed herein is an ammunition container including features that improve storage, transportation, and organization of the ammunition container. In one implementation, an ammunition container includes a first container portion comprising a first compartment and a first lid movable between a first open position and a first closed position and a second container portion comprising a second compartment and a second lid movable between a second open position and a second closed position, the second lid being independently movable from the first lid. The first container portion and the second container portion are coupled by a divider including a first divider wall and an opposite second divider wall, each of which extend between the first container portion and the second container portion. A handle is slidingly coupled to each of the first divider wall and the second divider wall such that the handle may be vertically translated between an extended position and a retracted position. When the handle is in either of the extended position and the retracted position, the lids remain movable between their respective open and closed positions.

In another implementation, an ammunition container includes a first container portion comprising a first compartment and a first lid movable between a first open position and a first closed position and a second container portion comprising a second compartment and a second lid movable between a second open position and a second closed position, the second lid being independently movable from the first lid. The first container portion and the second container portion are coupled by a divider including a first divider wall and an opposite second divider wall, each of which extend between the first container portion and the second container portion. A handle is rotatbly coupled to a top portion of each of the divider walls such that the handle may be rotated between a first position and a second substantially vertical position. In the first position, the handle is received in a channel or recess defined in the first lid such that a side surface of the handle is flush with a top surface defined by the lids.

BRIEF DESCRIPTION OF THE DRAWINGS

The above-recited and other advantages and features of the disclosure will become apparent by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Aspects of the present disclosure involve ammunition containers (also commonly referred to as "ammunition/ammo boxes" or "dry boxes"), including multiple compartments, each of which may be used to store different types of ammunition or shooting accessories. Ammunition containers in accordance with this disclosure may include two compartments, each of which having an individual lid that may be opened, closed, and secured independently of the lid of the other compartment. Other implementations may include more than two compartments. For example, an ammunition container may include four compartments with four corresponding lids. In such implementations, each compartment may have a separate lid. Alternatively, lids may be shared between adjacent compartments. For example, a given compartment may be subdivided into two portions with a lid providing access to both portions. As a result, organization of the ammunition and accessories within the ammunition container are improved.

Ammunition containers in accordance with the present disclosure also include handles adapted to be moved between positions depending on whether the ammunition containers are being transported or stored. For example, in one implementation, a sliding handle is included that may be extended into a first position to facilitate carrying of the ammunition container but retracted into a second position in which the handle does not interfere with other ammunition containers that may be stacked on top of the ammunition container. In certain implementations, the sliding handle does not interfere with the lids of the compartments such that the lids may be opened and closed regardless of whether the sliding handle is extended or retracted. In other implementations, a rotating handle is included that may be folded up to facilitate carrying but can be rotated into a downward position in which the handle is disposed in a recess of an adjacent lid. Again, this allows stacking of other ammunition containers without interference from the handle.

Other features of ammunition containers in accordance with this disclosure are directed to stacking ammunition containers. For example, in certain implementations, lids of the ammunition container include recesses shaped to receive and positively engage corresponding feet of another ammunition container. As a result multiple ammunition containers may be securely stacked on top of each other for ease of storage and transportation.

Figure 1:
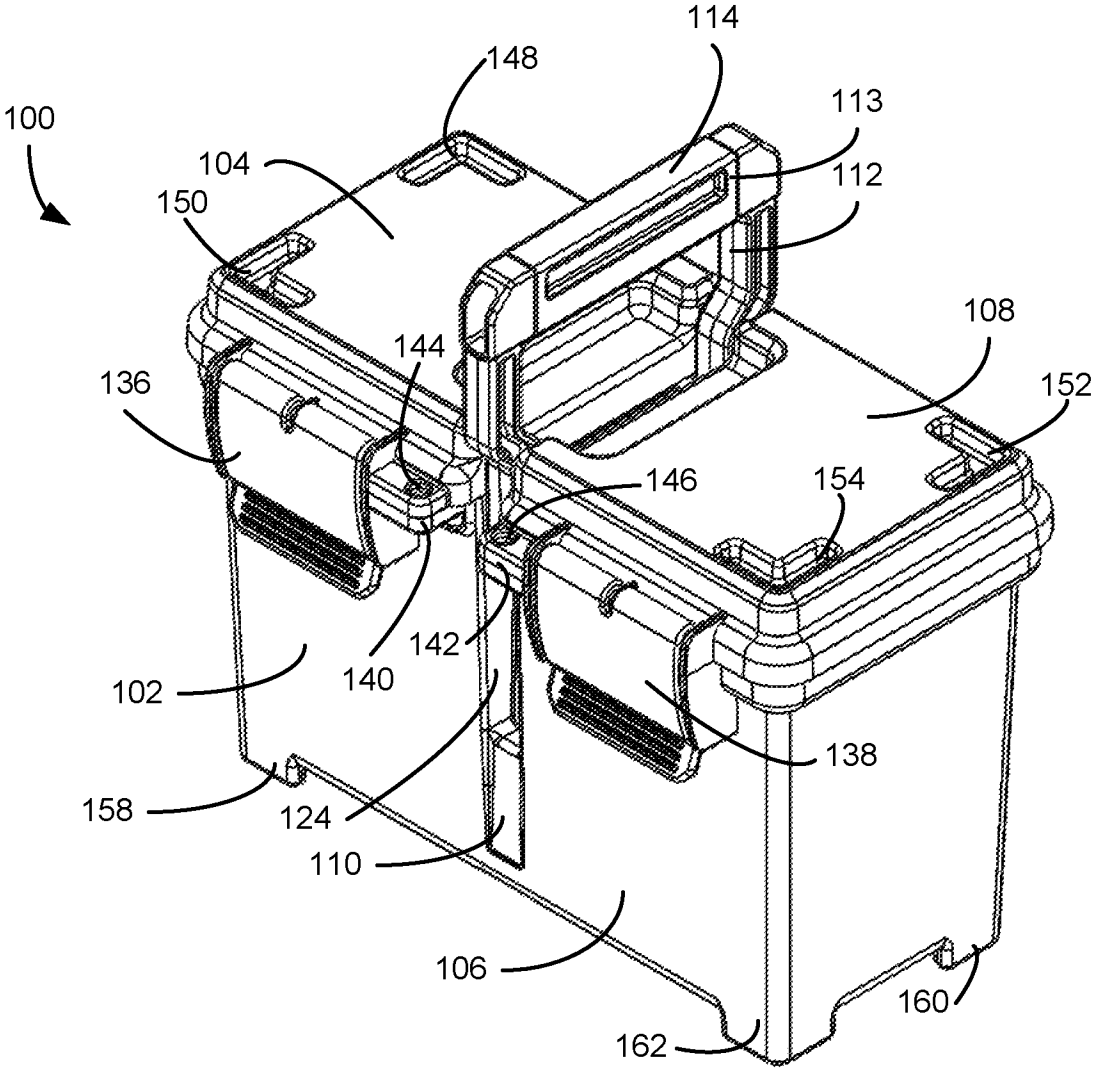
FIG. 1 is an isometric view of a first ammunition container with a handle in an extended position.
Figure 2:
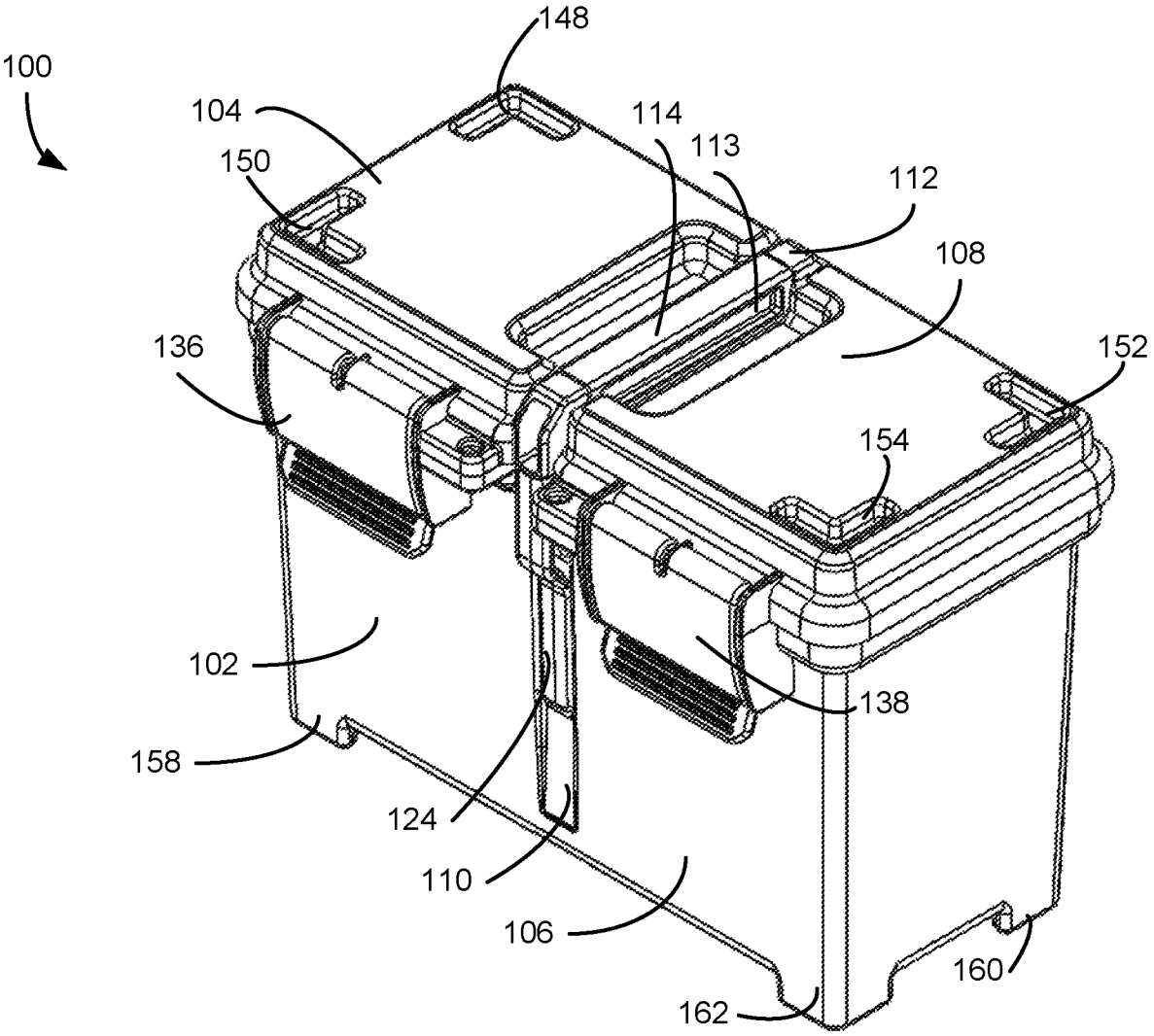
FIG. 2 is an isometric view of the ammunition container of FIG. 1 with the handle in a retracted position.

FIGS. 1 and 2 are isometric views of a first ammunition container 100 according to the present disclosure in an extended and retracted configuration, respectively. The ammunition container 100 includes two adjacent compartments 102, 106, each having respective lids 104, 108. The lids 104, 108 are coupled to their respective compartments 102, 106 such that each lid 104, 108 may be opened and closed independently.

The compartments 102, 106 are adjoined by a divider 110 to which a handle 112 is coupled. As illustrated, the ammunition container 100 is substantially symmetrical about the divider 100 such that the first compartment 102 and the first lid 104 are reflective of the second compartment 106 and the second lid 108. In other implementations, the compartments 104, 106 may be different shapes and sizes or may include different structural features. A top portion 113 of the handle 112 extends between the compartments 102, 106 parallel to the dividing wall 110. The handle 112 is coupled to the dividing wall 110 such that the handle 112 may be selectively extended and retracted. FIG. 1, for example, illustrates the handle 112 in an extended position while FIG. 2 illustrates the handle 112 in the retracted position.

When the handle 112 is in the retracted position, a top surface 114 of the top portion 113 of the handle 112 is flush with or below top surfaces 116, 118 of the lids 104, 108. Accordingly, other items, including other ammunition containers in accordance with this disclosure, may be readily stacked on top of the ammunition container 100. To facilitate extension of the handle 112 from the retracted position, each of the lids 104, 108 may define grooves or cutouts such that the handle 112 may be readily grasped while in the retracted position.

Figure 3:
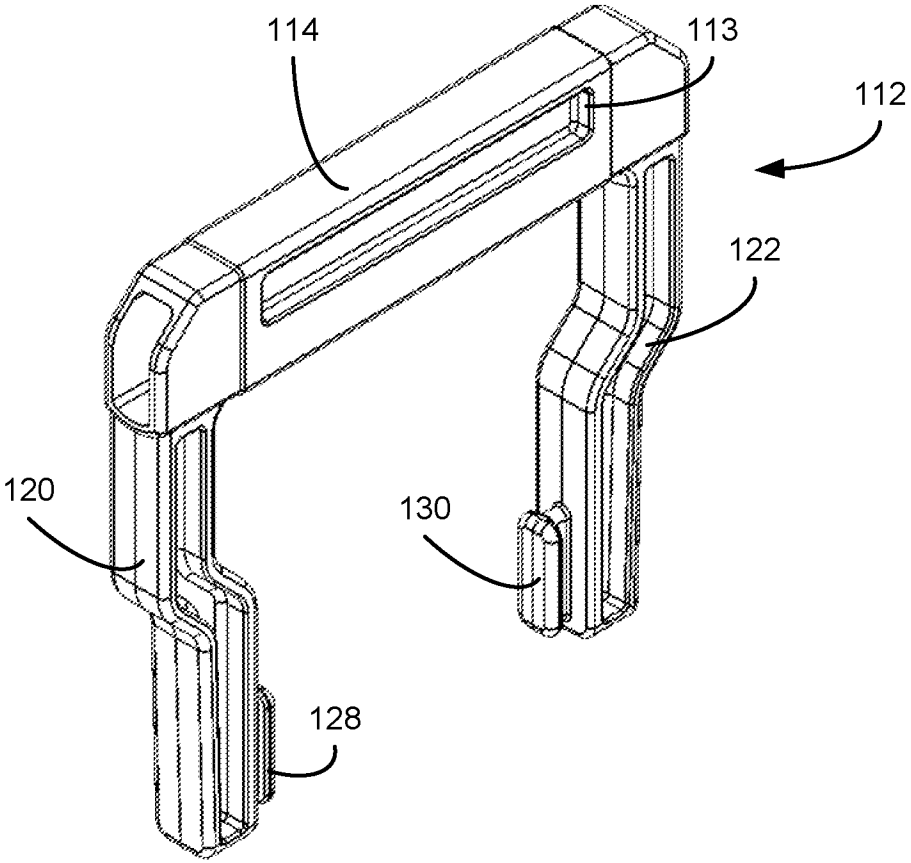
FIG. 3 is an isometric view of the handle of the ammunition container of FIG. 1.
Figure 4:
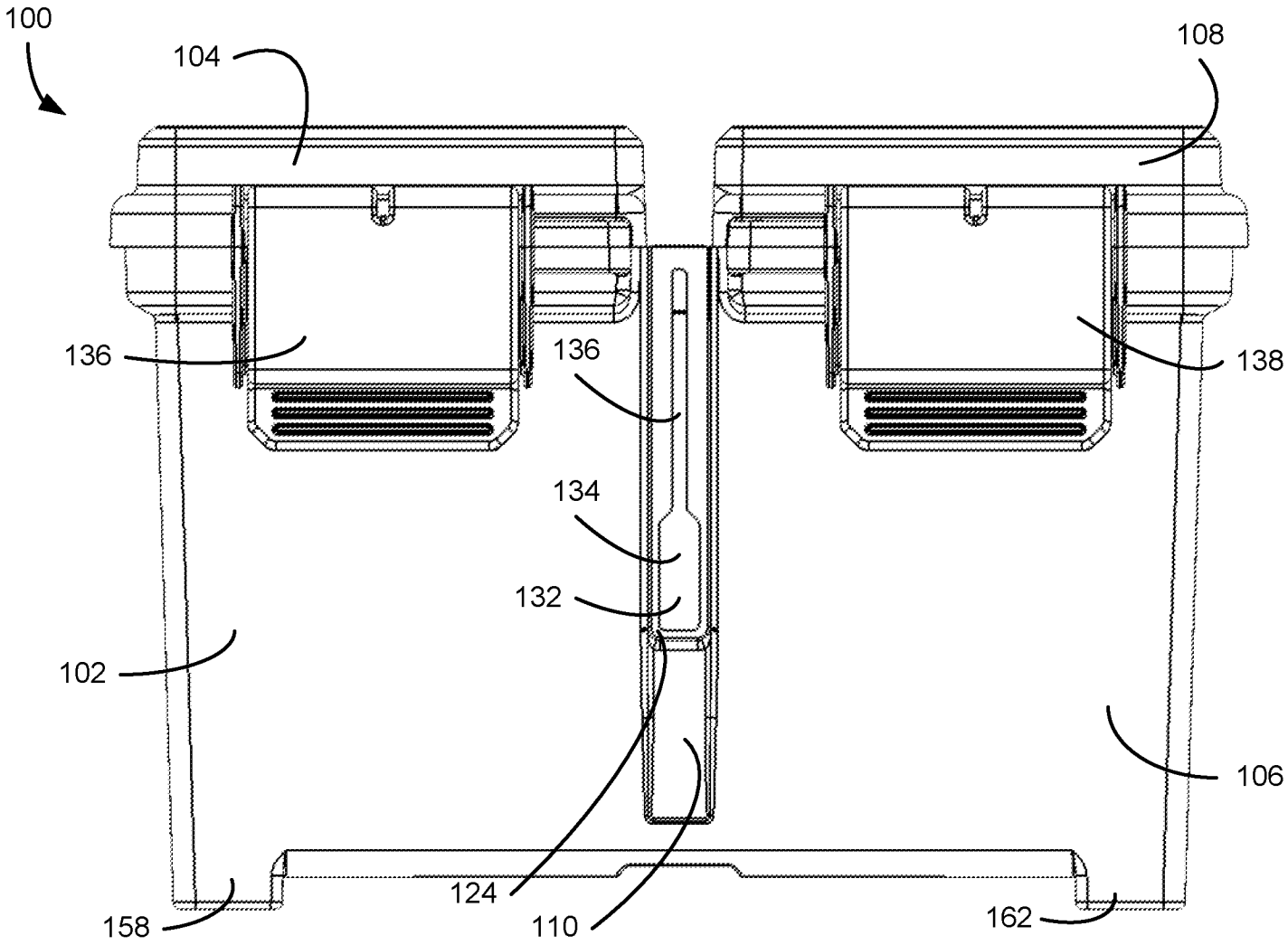
FIG. 4 is a front elevation view of the ammunition container of FIG. 1 with the handle removed.

FIG. 3, is an isometric view of the handle 112 shown in FIGS. 1 and 2 and FIG. 4 is a front view of the ammunition container 100 of FIGS. 1 and 2 with the handle 112 removed. Referring to FIG. 3, the handle 112 generally includes a top portion 113 and a pair of handle extensions 120, 122 extending therefrom. The handle extensions 120, 122 are shaped to be received by grooves, such as a first handle channel 124 (shown, for example, in FIG. 1) defined by the compartments 102, 106 and the divider 110. A second handle channel may be disposed opposite the first channel 124 and also defined by the compartments 102, 106 and the divider 110. Each of the handle extensions 120, 122 may include features adapted to couple the handle 112 to corresponding features of the divider 110. For example, the handle 112 includes t-shaped protrusions 128, 130 disposed on the inside of distal ends of the handle extensions 120, 122, respectively. As shown in FIG. 4, the divider 110 may include a first slot 132 and a second slot (not shown) disposed opposite the first slot 132 adapted to receive the coupling features of the handle 112. For example, the first slot 132 includes a wide section 134 into which a first t-shaped protrusion 128 may be inserted. The second t-shaped protrusion 130 may also be inserted into a corresponding wide section of the second slot. When the handle 112 is extended, the t-shaped protrusions 128, 130 may then engage narrow sections of the divider slots, such as the narrow section 134 of the first slot 132.

Referring back to FIGS. 1 and 2, the ammunition container 100 may include closures for retaining the lids 104, 108 in a closed configuration. For example, the ammunition container 100 includes hinged clasps 136, 138 coupled to each of the lids 104, 108 that may be rotated and pressed down to engage retention features of the compartments 102, 106. To open the lids 104, 108, the clasps 136, 138 may be pulled to disengage the retention features and rotate away from the compartments 102, 106. In other implementations of the present disclosure, other closure may be used to secure the lids 104, 108 in a closed position. For example, such closures may include, but are not limited to, one or more of twist lock closures, strap and buckle arrangements, clips, and drawbolt closures. In other implementations, the lids 104, 108 may also be retained by interference or press fits with an upper portion of the compartments 102, 106 such that no additional closure is required. In still other implementations, the lids 104, 108 may include a lip or groove extending around their circumference that mates with a corresponding groove or lip, respectively disposed on an upper portion of the compartments 102, 106.

The ammunition container 100 may also include features for locking the lids 104, 108 into the closed position relative to the compartments 102, 106. For example, the ammunition container 100 of FIGS. 1 and 2 includes lock tabs 140, 142 defining respectively lock holes 144, 146 through which a shackle or shank of a lock, such as a padlock or combination lock, may be inserted. In certain implementations, a lock mechanism may be incorporated directly into the ammunition container 100. For example, a key or combination lock may be integrated into the ammunition container 100 to lock the lids 104, 108 to their corresponding compartments 102, 106. Such locking mechanisms may be incorporated into or used instead of the closure mechanisms described above. For example, in implementations in which a drawbolt closure is used, the drawbolt closure may include an integrated key lock.

Figure 5:
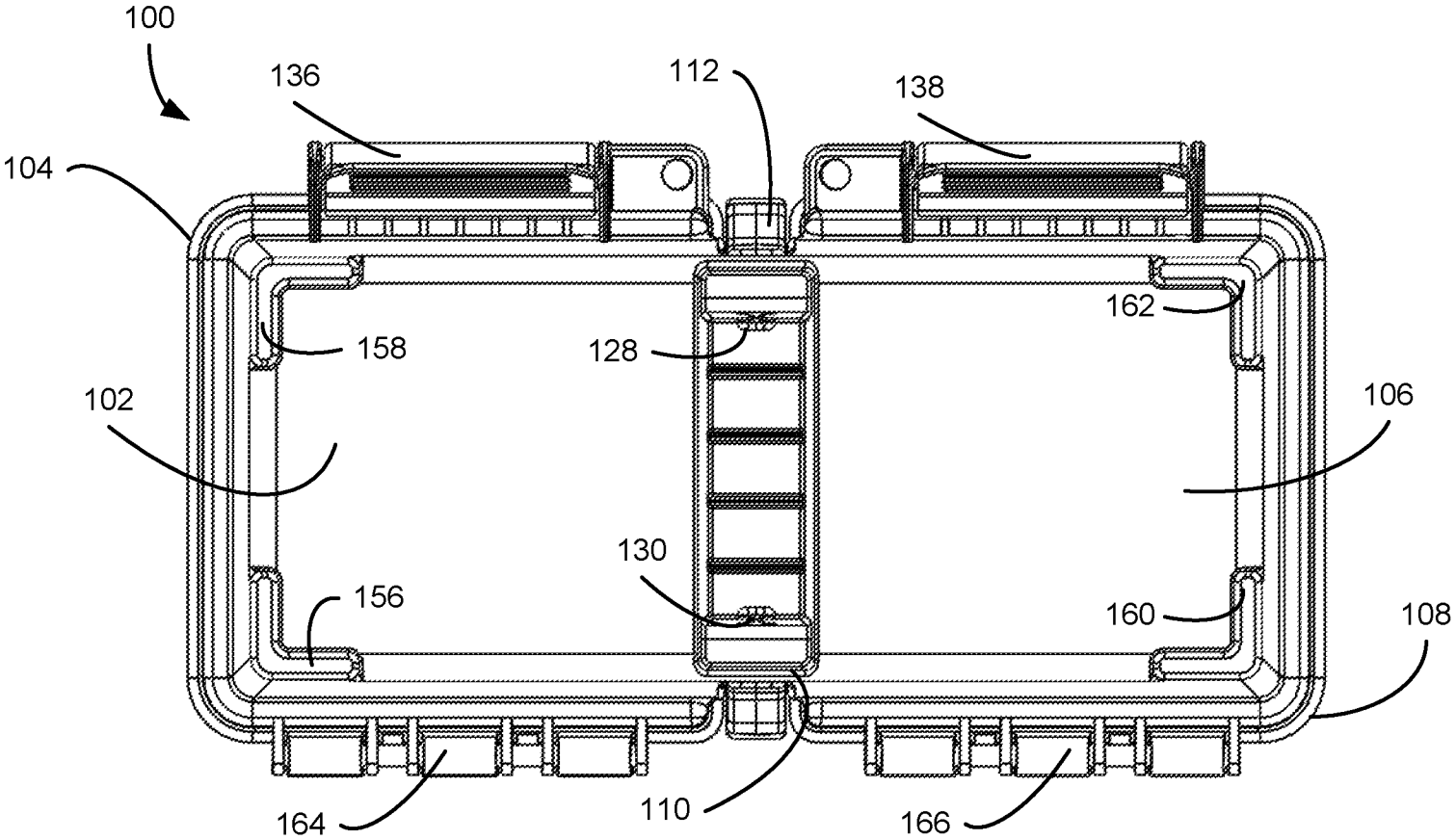
FIG. 5 is a bottom plan view of the ammunition container of FIG. 1.

The ammunition container 100 may further include features to facilitate stacking of the ammunition container 100 with similar containers for purposes of storage and transportation. For example, as shown in FIGS. 1 and 2, each of the lids 104, 108 include pairs of indentations 148-154. The indentations 148-154 are generally shaped to mate with corresponding feet 156-162 disposed at the bottom of the ammunition container 100 and which are most clearly shown in FIG. 5, which is a bottom plan view of the ammunition container 100. In certain implementations, the feet 156-162 and the indentations 148-154 are shaped such that an interference fit occurs when the feet 156-162 of the ammunition container 100 are inserted into the corresponding indentations of a second ammunition container or vice versa. In such implementations, a positive engagement is created between the feet and the indentations such that decoupling of the ammunition containers is resisted. Although four angled indentations and feet are included in the ammunition container 100, other shapes and quantities of indentations and feet may be used in a similar manner as described above.

In certain implementations, the compartments 102, 106 and/or the lids 104, 108 may include a gasket or similar sealing element such that a seal is formed between the compartments 102, 106 and their respective lids 104, 108 when the lids 104, 108 are closed. For example, in certain implementations, the lids 104, 108 may include a gasket extending around their perimeter such that a water-tight seal is formed between the lids 104, 108 and the compartments 102, 106 when the lids 104, 108 are closed and the clasps 136, 138 are engaged. Provided a suitable seal results, such gaskets may be formed of varying materials including, without limitation, rubber and plastic.

Figure 6:
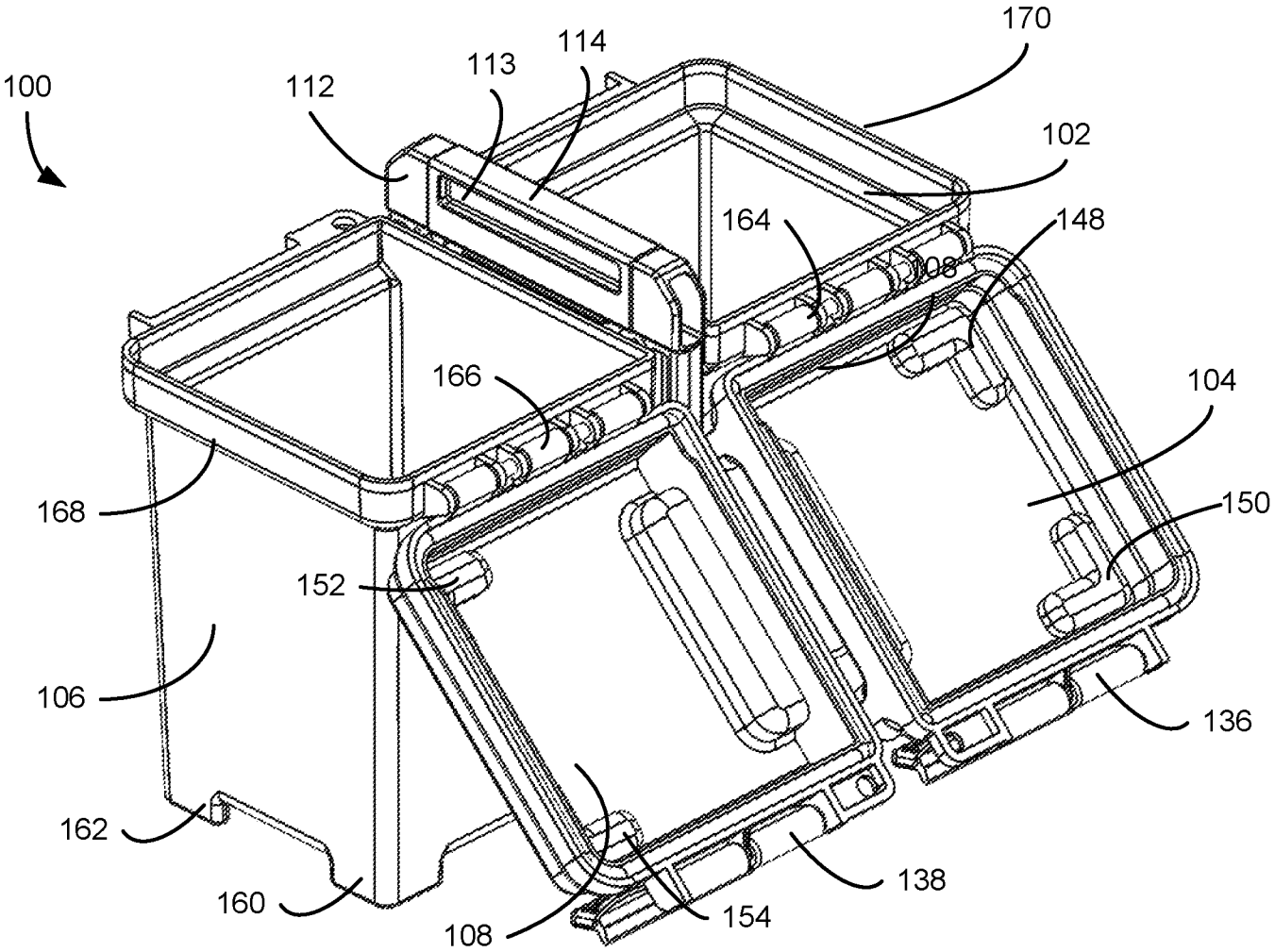
FIG. 6 is a rear isometric view of the ammunition container of FIG. 1 in an open configuration.

FIG. 6 is a rear isometric view of the ammunition container 100 shown in an open configuration. As shown, the lids 104, 108 are coupled to their corresponding compartments 102, 106 by respective hinges 164, 166. The hinges 164, 166 are shown as being integrally formed, at least in part, with the lids 104, 108 and the compartments 102, 106. In other implementations, the hinges 164, 166 may be separate but coupled to the lids 104, 108 and the compartments 102, 106. Moreover, while the hinges 164, 166 are shown as pin-type hinges, other hinge types, such as living hinges, may be used instead of pin-type hinges.

As shown in FIG. 6, the hinges 164, 166 are disposed opposite the clasps 136, 138. However, in other implementations, the hinges 164, 166 may disposed on adjacent sides of the compartments 102, 106. For example, in one implementation, the hinges may be disposed on the outer faces 168, 170 of the ammunition container such that each lid 104, 108 opens in an outward direction. Alternatively, the clasps 136, 138 or other closures may be disposed on the outer faces 168, 170.

Each compartment 102, 106 may include internal dividers (not shown) to further subdivide the internal volume of the compartments 102, 106. Such dividers may, for example, divide the internal volume of the compartments 102, 106 into separate horizontal layers, vertical columns, or a combination of horizontal layers and vertical columns. Internal dividers may be permanently disposed within the compartments 102, 106, such as by integrally forming the dividers with the compartments 102, 106. Alternatively, the internal dividers may be removable from within the compartments 102, 106 such that the arrangement of subdivisions within the compartments 102, 106 may be changed according to the needs of a user. In certain implementations, the internal surface of the compartments 102, 106 may include grooves, lips, channels, or similar features shaped to receive the dividers.

Although the ammunition container 100 is illustrated as including only two compartments 102, 106, other implementations of the present disclosure may include any suitable number of compartments. For example, in one implementation, additional compartments may be disposed adjacent each of the compartments 102, 106 such that the resulting ammunition container includes four collinear compartments. In another implementation, the additional compartments may be disposed adjacent to each other such that the compartments are in parallel (e.g., the compartments may be arranged along the divider). In implementations including more than two compartments, each compartment may include independent lids or, alternatively, subsets of the compartments may share a lid. For example, each compartment disposed on a first side of the handle 112 may share a first lid while each compartment disposed on a second side of the handle 112 may share a second lid. The lids of adjacent compartments may be configured to open in the same direction or in opposite directions. For example, in an implementation in which all compartments are in a collinear arrangement, adjacent compartments (or adjacent subsets of compartments sharing lids) may be configured such that their respective lids open in alternating directions. Similarly, in implementations in which compartments are arrange in parallel, lids of adjacent compartments may be configured to open in opposite directions (e.g., towards each other).

Figure 7:
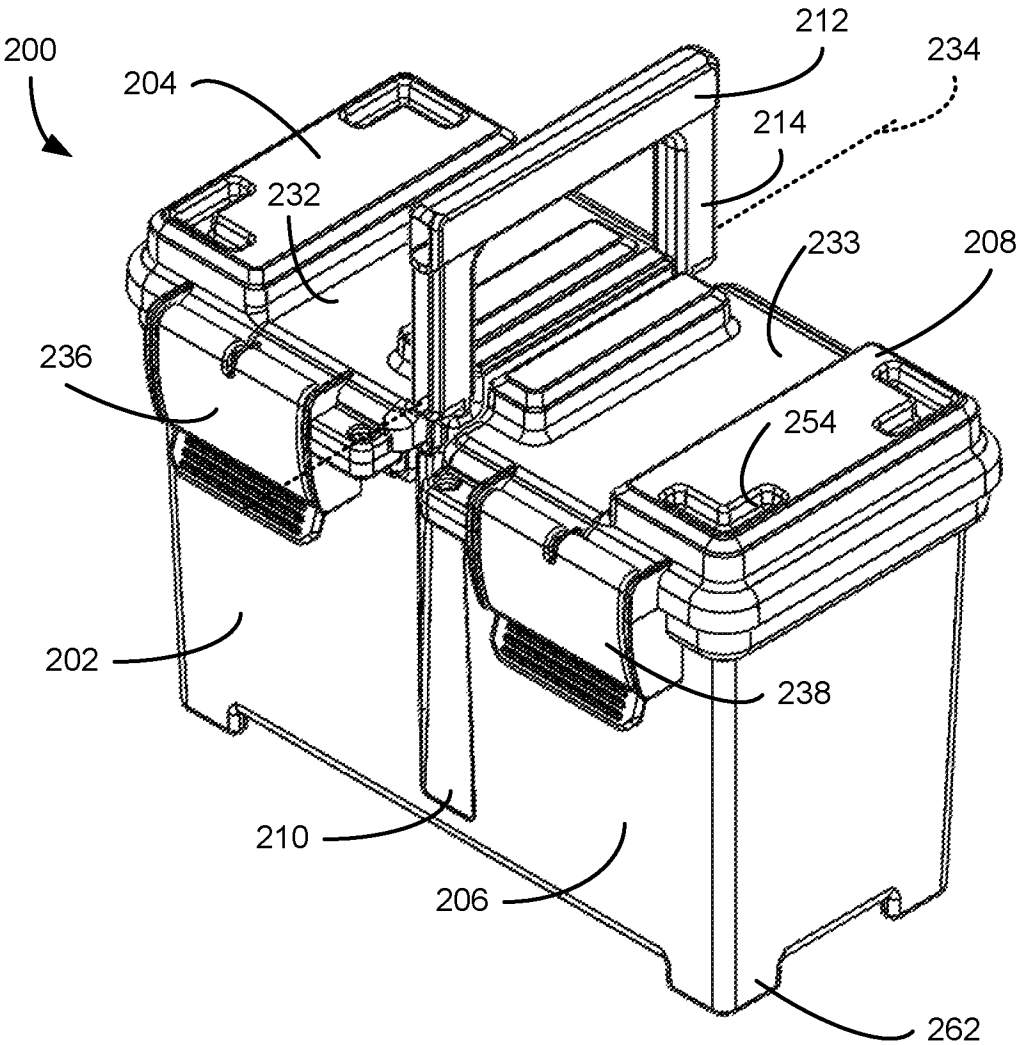
FIG. 7 is an isometric view of a second ammunition container with a handle in an upright position.
Figure 8:
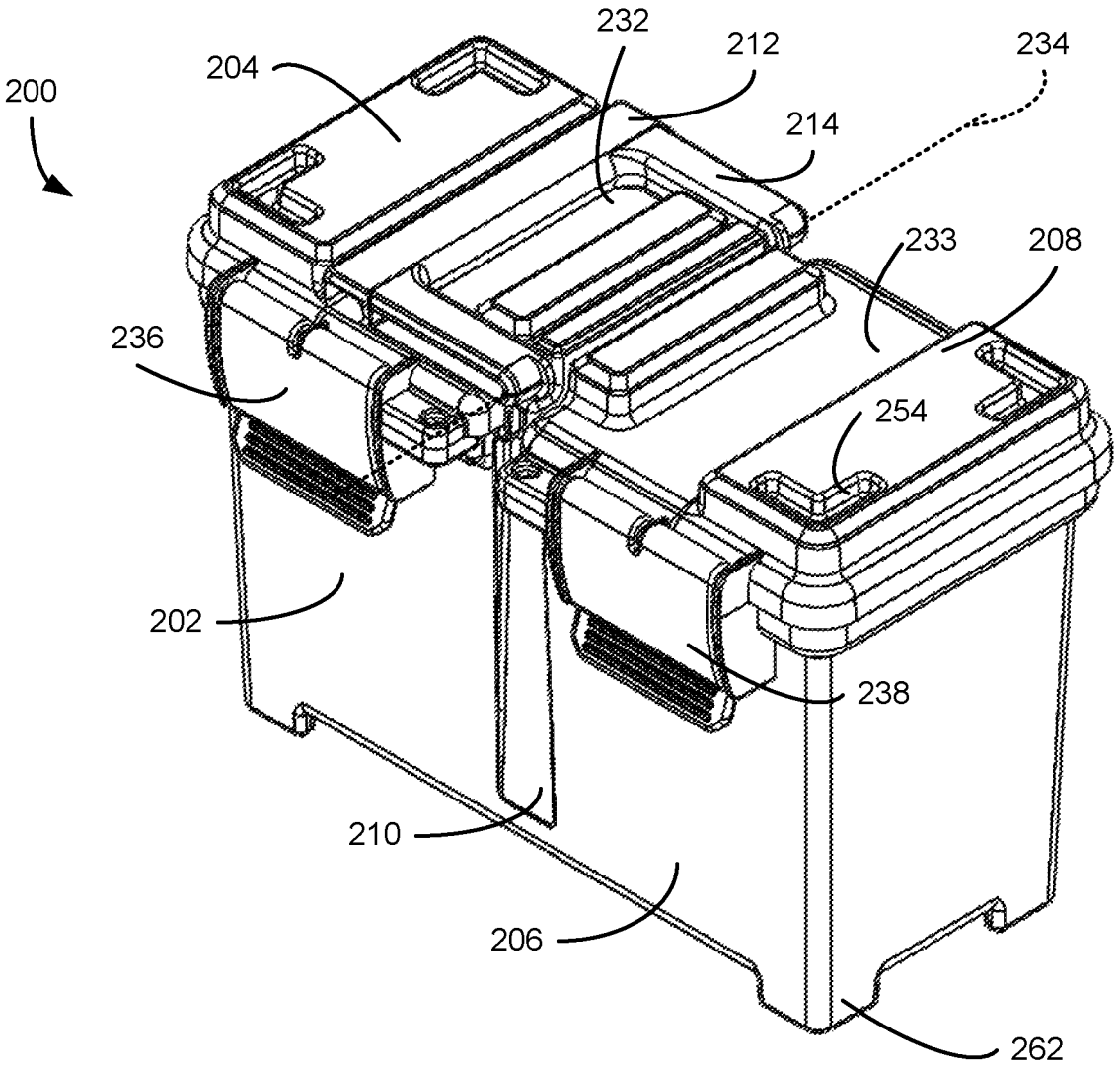
FIG. 8 is an isometric view of the ammunition container of FIG. 7 with the handle in a downed position.

FIGS. 7 and 8 are isometric views of a second ammunition container 200 according to the present disclosure. The ammunition container 200 includes two adjacent compartments 202, 206, each having respective lids 204, 208. The lids 204, 208 are coupled to their respective compartments 202, 206 such that each lid 204, 208 may be opened and closed independently.

The compartments 202, 206 are adjoined by a divider 210 to which a handle 212 is coupled. The handle 212 is coupled to the divider 210 such that the handle 212 is permitted to rotate or swivel about an axis of rotation 234 extending through an upper portion of the divider 210. More specifically, the handle 212 is permitted to rotate between an upright position, as shown in FIG. 7, and a downed position, as shown in FIG. 8 in which the handle 212 is folded down into a channel 232 or similar recess of the lid 204, the channel 232 being shaped to receive the handle 212 such that the handle 212 lies substantially flat. In the implementation illustrated in FIGS. 7 and 8, the handle 212 may also be folded into a second downed position by folding the handle 212 into a similar channel 233 of the lid 208. When the handle 212 is in the downed position, a side surface 214 of the handle 212 is flush with or below top surfaces 216, 218 of the lids 204, 208. Accordingly, other items, including other ammunition containers in accordance with this disclosure, may be readily stacked on top of the ammunition container 200.

Similar to the ammunition container 100 illustrated in FIGS. 1 and 2, the ammunition container 200 includes clasps 236, 238 for coupling the lids 204, 208 to their respective compartments 202, 206. The ammunition container 200 also includes feet, such as the foot 262, and corresponding indentations, such as indentation 254, to facilitate stacking of the ammunition container 200 with similar ammunition containers for purposes of transportation and storage. Other features and variations described above in the context of the ammunition container 100 of FIGS. 1 and 2 may also be incorporated into the ammunition container including a swiveling handled, such as the ammunition container 200.

Described above are implementations of an ammunition container. While multiple implementations are disclosed, still other implementations of the presently disclosed technology will become apparent to those skilled in the art from the foregoing detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context of particular implementations. Functionality may be separated or combined differently in various embodiments of the disclosure or described with different terminology. These and other variations, modifications, additions, and improvements may fall within the scope of the disclosure as defined in the claims that follow.

What is claimed is:

1. An ammunition container comprising:

a first container portion comprising a first compartment and a first lid coupled to the first compartment by a first hinge;

a second container portion comprising a second compartment and a second lid coupled to the second compartment by a second hinge, the second lid independently movable from the first lid;

a first divider wall extending and recessed between the first container portion and the second container portion to define a first vertical channel open on a first side of the ammunition container and a second divider wall extending and recessed between the first container portion and the second container portion to define a second vertical channel open on a second side of the ammunition container opposite the first side; and a handle vertically translatable between an extended position and a retracted position, the handle comprising:

a first vertical handle extension comprising a first upper vertical handle portion, a first lower vertical handle portion disposed below and inward of the first upper vertical handle portion, and a first projection extending inwardly from the first lower vertical handle portion, the first projection extending through and slidingly coupling to the first divider wall;

a second vertical handle extension comprising a second upper vertical handle portion, a second lower vertical handle portion disposed below and inward of the second upper vertical handle portion, and a second projection extending inwardly from the second lower vertical handle portion, the second projection extending through and slidingly coupling the handle to the second divider wall; and a handle top portion extending laterally between the first upper vertical handle portion and the second upper vertical handle portion, wherein, when the handle is in each of the retracted position and the extended position, the first lower vertical handle portion is disposed within the first vertical channel and the second lower vertical handle portion is disposed within the second vertical channel such that each of the first lower vertical handle portion and the second lower vertical handle portion abut each of the first container portion and the second container portion.

2. The ammunition container of claim 1, wherein:

the handle top portion comprises a top handle surface and the first lid and the second lid each comprise an upper surface that define a container top plane when the first lid and the second lid are closed, when in the retracted position, the top handle surface is flush with or below the container top plane, and at least one of the first lid and the second lid define a channel adjacent the handle when the handle is in the retracted position to facilitate gripping of the handle when in the retracted position.

3. The ammunition container of claim 1, wherein:

the first divider wall defines a first vertical slot, the second divider wall defines a second vertical slot, the first projection extends through the first vertical slot, and the second projection extends through the second vertical slot.

4. The ammunition container of claim 1, wherein the first container portion and the second container portion further comprise closures for maintaining the first lid and the second lid in the first closed position and the second closed position, respectively.

5. The ammunition container of claim 4, wherein the closures are each one of a clasp, a twist lock closure, a strap and buckle arrangement, a clip, and a drawbolt closure.

6. The ammunition container of claim 1, wherein the first container portion comprises a first lock feature and the second container portion further comprises a second lock feature, the first lock feature and the second lock feature for locking the first lid and the second lid, respectively.

7. The ammunition container of claim 6, wherein:

the first lock feature includes one of a first lock tab shaped to receive a first lock and a first locking mechanism integrated into the first container portion or, and the second lock feature includes one of a second lock tab shaped to receive a second lock and a second locking mechanism integrated into the second container portion.

8. The ammunition container of claim 1, wherein the first container portion and the second container portion are substantially symmetrical about each of the first divider wall and the second divider wall.

9. The ammunition container of claim 1 further comprising:

a bottom surface comprising a plurality of feet extending therefrom, wherein the first lid and the second lid further collectively define a plurality of recesses shaped to receive and engage the plurality of feet such that feet of a second ammunition container may be inserted into the recesses to stack the second ammunition container on top of the ammunition container.

10. The ammunition container of claim 1, wherein, the first compartment and the second compartment are isolated from each other.

11. The ammunition container of claim 1, wherein when the first lid forms a first seal with the first compartment when in the first closed position and the second lid forms a second seal with the second compartment with in the second closed position.

12. The ammunition container of claim 11, wherein the first seal is formed, at least in part, by a first gasket disposed between the first compartment and the first lid and the second seal is formed, at least in part, by a second gasket disposed between the second compartment and the second lid.

13. The ammunition container of claim 1, wherein, in the retracted position, the first upper vertical portion and the second upper vertical portion project laterally outward beyond the first vertical channel and the second vertical channel, respectively.

14. The ammunition container of claim 1, wherein when the handle is in the extended position, the first upper vertical portion and the second upper vertical portion are disposed entirely above the first vertical channel and the second vertical channel, respectively.

15. A container comprising:

a plurality of container portions including a pair of adjacent container portions, each of the adjacent container portions comprising a respective lid;

a divider disposed between the adjacent container portions the divider and the adjacent container portions defining a first vertical channel including a first channel wall and a second vertical channel including a second channel wall, the first vertical channel and the second vertical channel disposed on opposite sides of the divider and extending between the adjacent container portions; and a handle vertically translatable between an extended position and a retracted position, the handle comprising:

a first vertical handle extension comprising a first upper vertical handle portion, a first lower vertical handle portion disposed below and inward of the first upper vertical handle portion, and a first projection extending inwardly from the first lower vertical handle portion, the first projection extending through and slidingly coupling the handle to the first channel wall;

a second vertical handle extension comprising a second upper vertical handle portion, a second lower vertical handle portion disposed below and inward of the second upper vertical handle portion, and a second projection extending inwardly from the second lower vertical handle portion, the second projection extending through and slidingly coupling the handle to the second channel wall; and a handle top portion extending laterally between the first upper vertical handle portion and the second upper vertical handle portion, wherein, when the handle is in each of the retracted position and the extended position, the first lower vertical handle portion is disposed within the first vertical channel and the second lower vertical handle portion extension is disposed within the second vertical channel such that each of the first lower vertical handle portion and the second lower vertical handle portion abut each of the first container portion and the second container portion.

16. The container of claim 15, wherein:

each of the respective lids comprises an upper surface that collectively define a container top plane when each of the respective lids is closed, and the handle comprises an upper surface, the handle configured such that the upper surface of the handle is disposed flush with or below the container top plane when the handle is positioned in the retracted position.

17. A container comprising:

a plurality of container portions including a first container portion including a first lid and a second container portion adjacent the first container portion, the second container portion including a second lid;

a first vertical channel extending between the first container portion and the second container portion and including a first channel wall and a second vertical channel extending between the first container portion and the second container portion and including a second channel wall, the second vertical channel disposed opposite the first vertical channel; and a handle translatable between a first extent and a second extent, the handle comprising:

a first vertical handle extension comprising a first upper vertical handle portion, a first lower vertical handle portion disposed below and inward of the first upper vertical handle portion, and a first projection extending inwardly from the first lower vertical handle portion, the first projection extending through and slidingly coupling the handle to the first channel wall;

a second vertical handle extension comprising a second upper vertical handle portion, a second lower vertical handle portion disposed below and inward of the second upper vertical handle portion, and a second projection extending inwardly from the second lower vertical handle portion, the second projection extending through and slidingly coupling the handle to the second channel wall; and a handle top portion extending laterally between the first upper vertical handle portion and the second upper vertical handle portion, wherein, the first extent and the second extent define a range of motion of the handle and across the range of motion, each of the respective lids remains movable between an open position and a closed position.

18. The container of claim 17, wherein the handle is movable between the first extent and the second extent by vertically translating the handle.

* * * * *